United States Patent [19]

Rettew

[11] 4,168,941

[45] Sep. 25, 1979

[54] ROTARY VANE MACHINE WITH ROLLER SEALS FOR THE VANES

[76] Inventor: Richard Rettew, Box 65, R.D. 1, Newmanstown, Pa. 17073

[21] Appl. No.: 842,179

[22] Filed: Oct. 14, 1977

[51] Int. Cl.[2] ..... F01C 19/00; F01C 1/00; F01C 21/04

[52] U.S. Cl. ..... 418/83; 418/91; 418/137

[58] Field of Search ..... 418/83, 91, 136–138, 418/241

[56] References Cited

U.S. PATENT DOCUMENTS

| | | | |
|---|---|---|---|
| 410,431 | 9/1889 | McCaskey et al. | 418/138 |
| 2,022,207 | 11/1935 | Kratzer | 418/137 |
| 2,044,873 | 6/1936 | Beust | 418/137 |
| 2,370,934 | 3/1945 | Brown | 418/137 |
| 2,536,851 | 1/1951 | Latham, Jr. | 418/91 |
| 3,323,501 | 6/1967 | Balve | 418/83 |
| 3,883,277 | 5/1975 | Keller | 418/137 |
| 3,886,909 | 6/1975 | Balsbaugh | 418/173 |

FOREIGN PATENT DOCUMENTS

| | | | |
|---|---|---|---|
| 1351130 | 12/1963 | France | 418/137 |
| 7167 | of 1895 | United Kingdom | 418/241 |

*Primary Examiner*—John J. Vrablik
*Attorney, Agent, or Firm*—Robert D. Yeager

[57] ABSTRACT

A rotary vane machine utilizing tapered vanes which are rotatably connected to a stationary center shaft and which extend through openings in the wall of an off-center hollow cylindrical rotor into sliding contact with an inner wall of the machine. Working chambers are formed between the vanes outside of the hollow rotor. Roller seals are provided in the rotor wall openings to isolate the inside of the rotor from the working chambers. Rollers which form the seals are disposed, with a close tolerance, in slots formed in the rotor wall openings on each side of the tapered vanes. A small opening, which communicates with one of the working chambers, is formed in the back of each roller slot to admit pressurized fluid from the working chamber to help bias the roller seals into contact with the tapered vanes. A check valve may be provided in the small opening to maintain pressure behind the roller seal. The roller seals are spring biased against the vanes and the roller slots are oriented so during operation centrifugal force urges the rollers against the tapered vanes.

14 Claims, 6 Drawing Figures

ROTARY VANE MACHINE WITH ROLLER SEALS FOR THE VANES

BACKGROUND OF THE INVENTION

1. Field of the Invention

This invention relates to rotary machines and more particularly to a rotary machine having a plurality of rotatable vanes attached to a stationary center shaft and extending through an off-center hollow rotor into sliding contact with the inner wall of a housing.

2. Description of the Prior Art

Rotating machines utilizing rotatable vanes attached to a stationary center shaft and extending through a rotatable off-center hollow cylindrical rotor into sliding contact with the wall of a housing are known in the prior art. U.S. Pat. No. 3,892,502 issued to E. Pritchard and U.S. Pat. No. 3,976,403 issued to R. L. Jensen are exemplary of such machines. A problem with some prior art rotary vane machines is that they cannot successfully operate under high pressure and heat. This inability to operate under high pressure and heat is due to poor seals on the vanes and high torque on the vanes.

Several prior art vane type machines utilize a half moon slide and swivel type seal. These type seals allow the blades to slide in and out through the seal between the half moons and also permit swivel motion. A problem with this type construction is that the pressure on the seal, when used in an internal combustion engine, can develop a very high force which can damage or destroy the seal.

U.S. Pat. Nos. 3,748,068; 3,797,975; and 3,883,277 illustrate rotary vane devices wherein one or more rollers are disposed between adjacent vanes. The rollers serve as vane guides and provide a seal as the vane moves. The rollers serve as a part of a piston as well as an interdigitating means for the vanes. Each roller is rotatably mounted on a shaft which extends between circular plates.

U.S. Pat. No. 3,886,909 illustrates a rotary internal combustion engine including an outer rotor and a smaller inner rotor having offset axes. A plurality of vanes are rotatably attached to a shaft, which is concentric with the outer rotor, and extend through slots in the inner rotor to make sliding contact with the inside wall of the outer rotor. As the vanes, which define combustion chambers therebetween, rotate they expose inlet and exhaust ports as well as spark plugs carried by the outer rotor. Seals which are provided in the inner rotor slots press against the two flat sides to help retain the compression and combustion forces within their respective chambers. The seals are aided by compression gases admitted to their back side through openings in the inner rotor.

SUMMARY OF THE INVENTION

This invention relates to a rotary machine utilizing tapered vanes which are rotatable around a center stationary shaft. The vanes extend through slotted openings in an off centered hollow cylindrical rotor to make sliding contact with the circular inner wall of a housing. Working or combustion chambers are formed between adjacent vanes and the inside of the housing and the outside of the rotor. Seals are provided in the slotted openings of the cylindrical rotor wall through which the vanes extend. Each seal permits sliding and swivel motion of the confined tapered vane. The seals isolate the outside of the rotor from the hollow inner portion.

Each seal is formed by a pair of rollers disposed in opposing slots formed on opposite sides of the opening in the rotor wall through which the vanes extend. The pair of rollers are biased into high pressure engagement with the vanes to form an effective seal. The opposing slots, within which the rollers are disposed, are oriented so that as the rotor moves, centrifugal force urges the rollers into contact with the tapered vanes. The rollers provide a very effective seal yet permit easy sliding and swivel motion of the vanes.

A small passage is formed into each roller slot, behind the associated roller. The passage is made small enough so that when the pressure on the outside of the rotor drops rapidly, pressure is still maintained behind the roller. In the area behind the rollers, there will be a build up of pressure from the combustion chamber. The pressure behind the roller will offset the pressure in front of the roller. Since the area behind the roller is always larger than the area in front, which is exposed to the combustion pressure, a lower pressure behind the roller will offset a greater pressure in front of the roller.

A leaf spring is also provided in the back of the roller slot to bias the roller against the movable vanes. The leaf spring insures that the roller remains centered and maintains contact with the associated vane. If desired, a check valve can also be formed in the passage which extends from the back of the roller slot to the outside of the rotor. The check valve will assure that high pressure is maintained against the back of the roller. As the vanes move in and out relative to the rotor, the engaging rollers will rotate. The roller slots are positioned relative to the rotors so that as the rotor moves rapidly, a strong centrifugal force will hold the rollers against the vane.

Oil is pumped through the center stationary shaft and forced out through oil holes into the chamber inside of the hollow cylindrical rotor where it fills the cavities behind the roller seals. Excess oil is ported at the ends of the rotor. The oil which passes through the inside of the rotor lubricates the vanes, bearings, and rollers and also helps cools the rotating rotor ring.

Cavities are provided in the housing, through which water can flow to provide water cooling for the rotary engine. The disclosed machine can be used as: (1) a two cycle gas or diesel engine; (2) a four cycle gas or diesel engine; (3) a pump; (4) a pressure operated motor using steam, air, gas or oil. The only change from the basic design required to accomplish the above type machines is the location and type of porting.

It is an object of this invention to teach a vane type rotary engine which is effective for operation under high internal pressures and high temperature conditions.

It is a further object of this invention to teach a seal for a vane type rotary engine wherein rollers are held against opposite sides of a vane to provide good sliding and swivel movement.

It is a further object of this invention to teach a vane type rotary engine utilizing tapered vanes which have high strength and permit high operating pressures and speed.

BRIEF DESCRIPTIONS OF THE DRAWINGS

For a better understanding of the invention, reference may be had to the preferred embodiments exemplary of the invention shown in the accompanying drawings in which.

DESCRIPTION OF THE PREFERRED EMBODIMENTS

Figure 4:
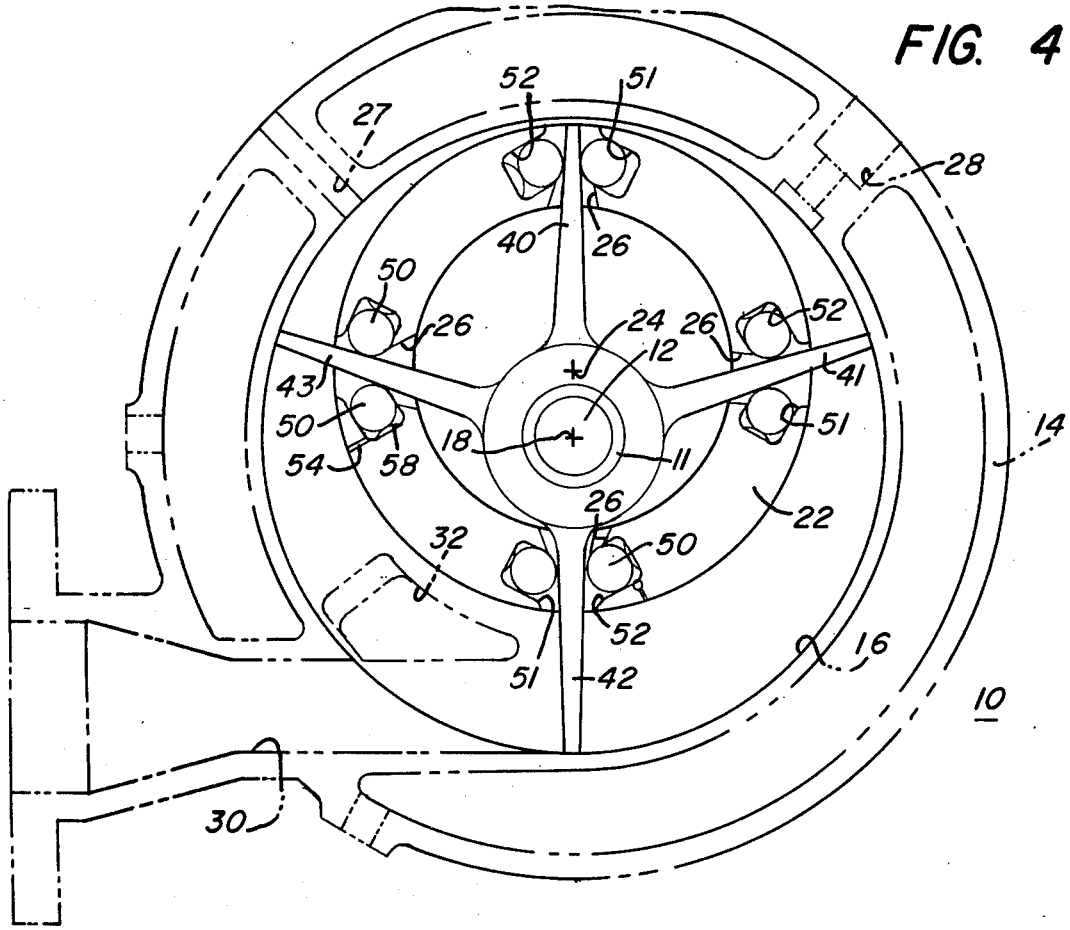
FIG. 4 is a schematic view of a vane type rotary engine with the vanes in a position where firing has just occurred.
Figure 5:
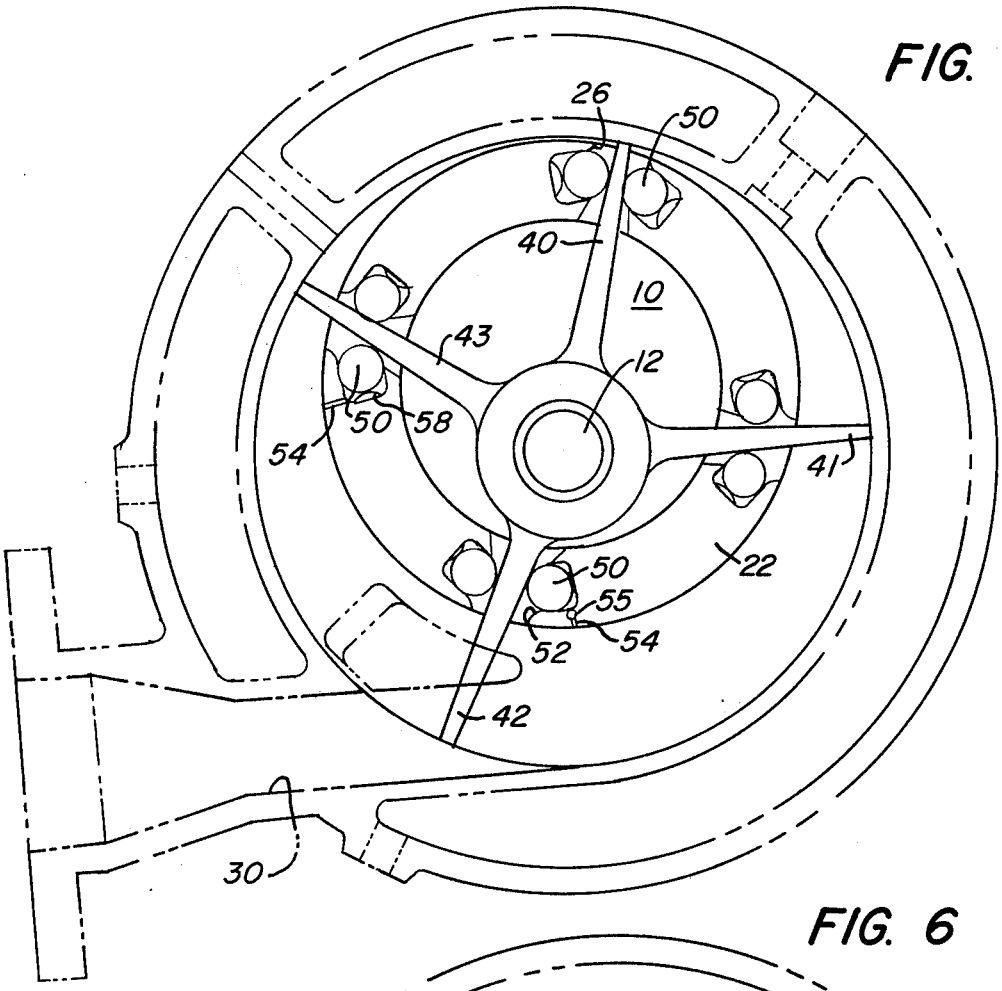
FIG. 5 is a view similar to FIG. 4 but at a slightly later time showing the rotor moved clockwise; and, FIG. 6 is a view similar to FIG. 4 illustrating the vanes positioned between the fuel injecting point and the firing point.
Figure 6:
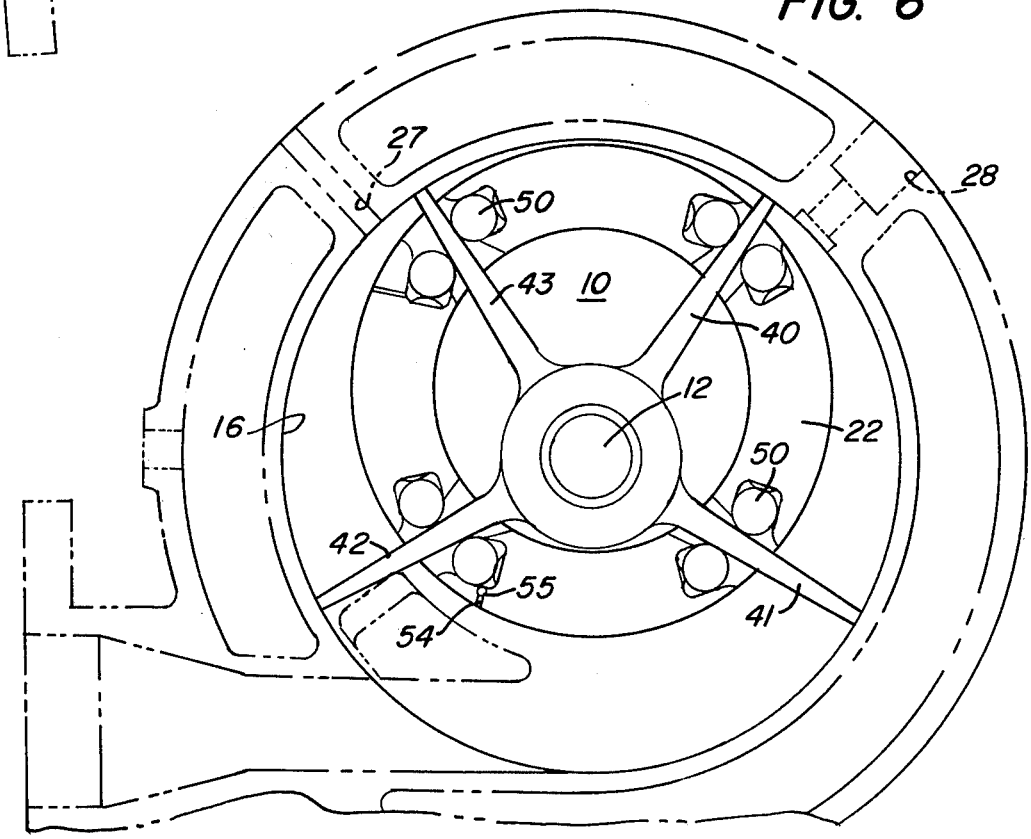

Referring now to the drawings and FIGS. 4 through 6 in particular there is shown schematic views of a vane type rotary engine 10 constructed according to the teaching of the present invention. Rotary engine 10 is a two cycle engine. The stationary center shaft 12 is disposed within a housing 14. The inner diameter 16 of housing 14 and shaft 12 are formed concentric around a longitudinal axis 18. Secured to stationary shaft 12 are a plurality of tapered vanes 40, 41, 42, and 43. Tapered vanes 40 through 43 are rotatably attached to stationary shaft 12 through bushings 11. A hollow rotor 22 is supported around the shaft 12 for rotation about an axis 24. The axis 24 of rotation of rotor 22 is off center from the axis 18 of stationary shaft 12. A plurality of openings 26 are formed in rotor 22. Vanes 40 through 43 extend through opening 26 into sliding contact with the inner diameter 16 of housing 14. As rotor 22 rotates, vanes 40 through 43 slide and swivel relative to rotor 22 and openings 26 therethrough. A fuel injection opening 27 and an ignition opening 28 are provided in housing 14. An exhaust port 30 and an intake port 32 are also provided.

When the vanes 40 through 43 are positioned as shown in FIG. 6, fuel injection has just been completed by vane 43 passing the fuel injection bore 27. The combustion or firing chambers for rotary engine 10 are formed between the outside of rotor 22 and the inner diameter 16 of housing 14 between adjacent vanes 40 through 43. As shown in FIG. 6, the fuel air mixture in the firing chamber between vanes 40 and 43 has been compressed and ignition is about to take place.

As soon as vane 40 passes ignition opening 28, the fuel air mixture fires building up pressure. As the pressure builds up, vane 40 is forced to the right causing rotor 22 to rotate. The pressure build up forces blade 41 clockwise, as seen in FIG. 6, until it reaches exhaust port 30 which allows the spent gases to flow out. As vane 41 reaches intake port 32, most of the exhaust gas between vanes 40 and 41 is out and the pressure is low. Blade 41 now opens intake port 32 allowing a fresh air charge to come in on both sides filling the firing chamber between vanes 40 and 41. Vanes 40 and 41 in conjunction with rotor 20 continue compressing the confined air until blade 40 reaches and passes fuel injection opening 27. The above described sequence is repeated for all blades 40 through 43.

The disclosed rotory engine 10 has a long power stroke, which makes for more complete use of the expanding gases before they exhaust. The long power stroke results in high efficiency and more complete combustion and hence less pollution. Inspite of the long stroke, the disclosed rotory engine 10 will run at high speed due to its rotary design. This disclosed construction results in a very high horsepower engine for its size. The engine is relatively inexpensive because all the parts are concentric and straight forward. There are no crank shaft, cam shaft, valves, or distributor required. In the disclosed engine continuous fuel injection and continuous ignition may be possible.

A problem with some prior art vane type rotary engines is that high pressure and heat caused problems with the vane seals. The disclosed engine 10 overcomes these problems by using tapered vanes 40 through 43 with a large radius at the heavy end of the vane where it is rotatably connected to stationary shaft 12. The vanes 40 through 43 are made of high strength alloy and hardened. The seals are rollers 50 which are also hardened. Rollers 50 are fitted into opposing hardened and ground slots 51 and 52. Rollers 50 fit within slots 51, 52 to a close tolerance around 0.0005 inches. The slots 51, 52 are slanted so that when the rotor 20 moves centrifugal force holds the rollers 50 against the vanes 40 through 43. A port or passage 54 is formed connecting the backs of slots 51, 52 to the working chambers. In the area behind roller 51, there will be a build up of pressure coming in from the firing chamber during the power stroke so that pressure on the front of the rollers 50 will be offset. Since the area behind the rollers is always at least ⅓ larger than the area in front of the rollers which is exposed to the pressure of the firing chamber, rollers 50 will remain in contact with vanes 40 through 43. Since rollers 50 are backed by high pressure gas, the effect is that of an air bearing which provides a tight seal with minimum friction.

Passage 54 is selected to be small enough so that when a vane 40 through 43 passes exhaust port 30 and pressure in the operating or combustion chamber rapidly drops pressure is still maintained behind roller 50.

Figure 3:
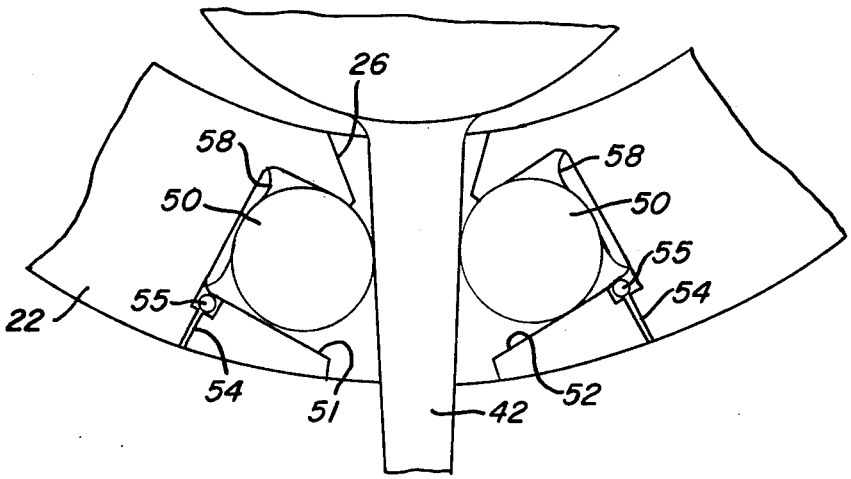
FIG. 3 is a view of roller seal according to an alternative embodiment of the invention with a check valve disposed in the passage connecting the roller slot to the pressure chamber.

Referring now to FIG. 3 there is shown a detailed view of another embodiment of the invention wherein pressure leakage from the back of slots 51, 52 is limited. In the emobodiment of FIG. 3, passage 54 includes a check valve 55 which prevents the pressure built up behind roller 50 from leaking back through passage 54 to the combustion chamber. Thus, during operation when the pressure in the combustion chamber is greater than the pressure in slots 51, 52 behind rollers 50, gas will flow through passage 54 to equalize these pressures. However, when the pressure of the working chamber drops, the ball check valve 55 will prevent the pressurized gases within slots 51, 52 from leaking through passage 54. A leaf spring 58 is provided behind each roller 52 to ensure that the roller 50 maintains contact with vane 20 and remains centered. The leaf spring 58 also limits maximum travel of roller 50.

Figure 1:
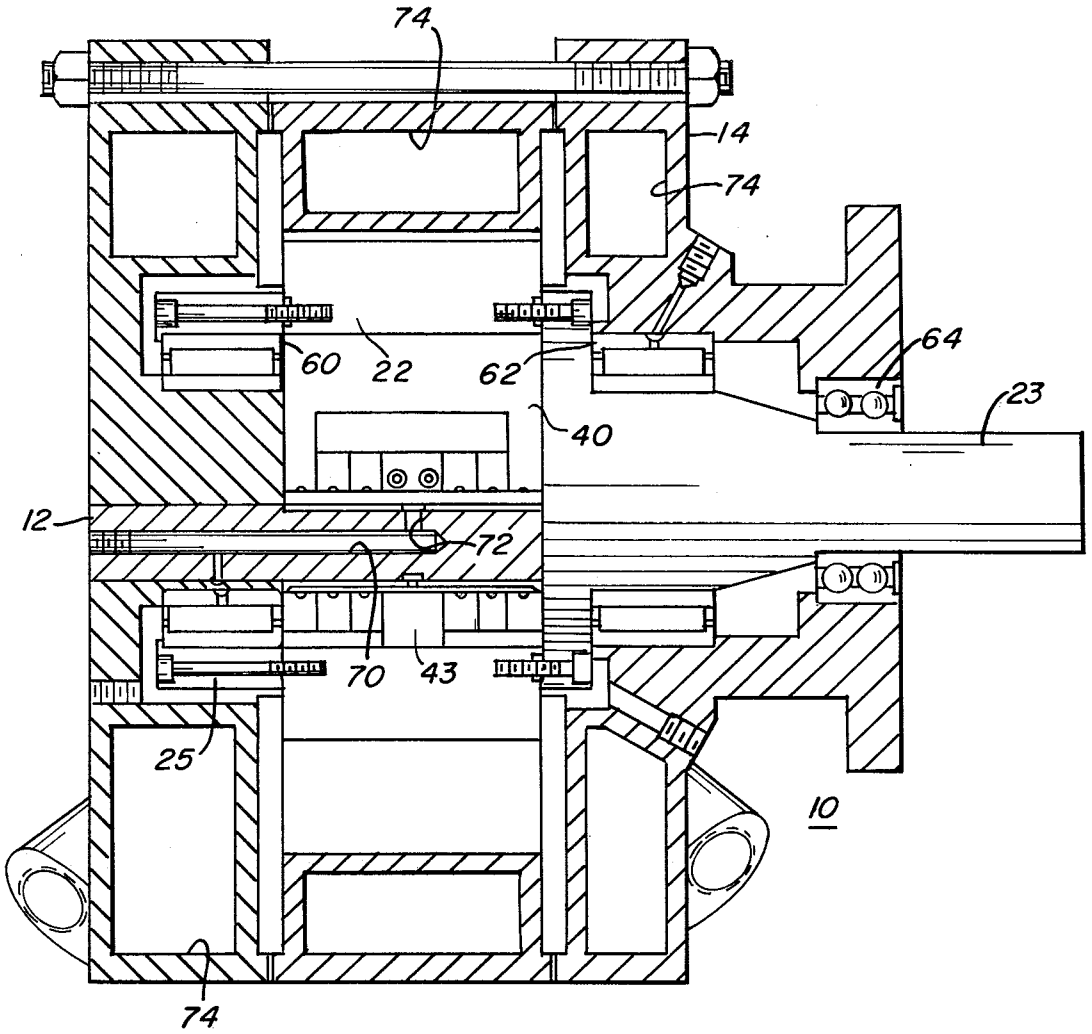
FIG. 1 is an assembly drawing, partially in section, of a two cycle rotary engine constructed according to the teaching of the present invention.
Figure 2:
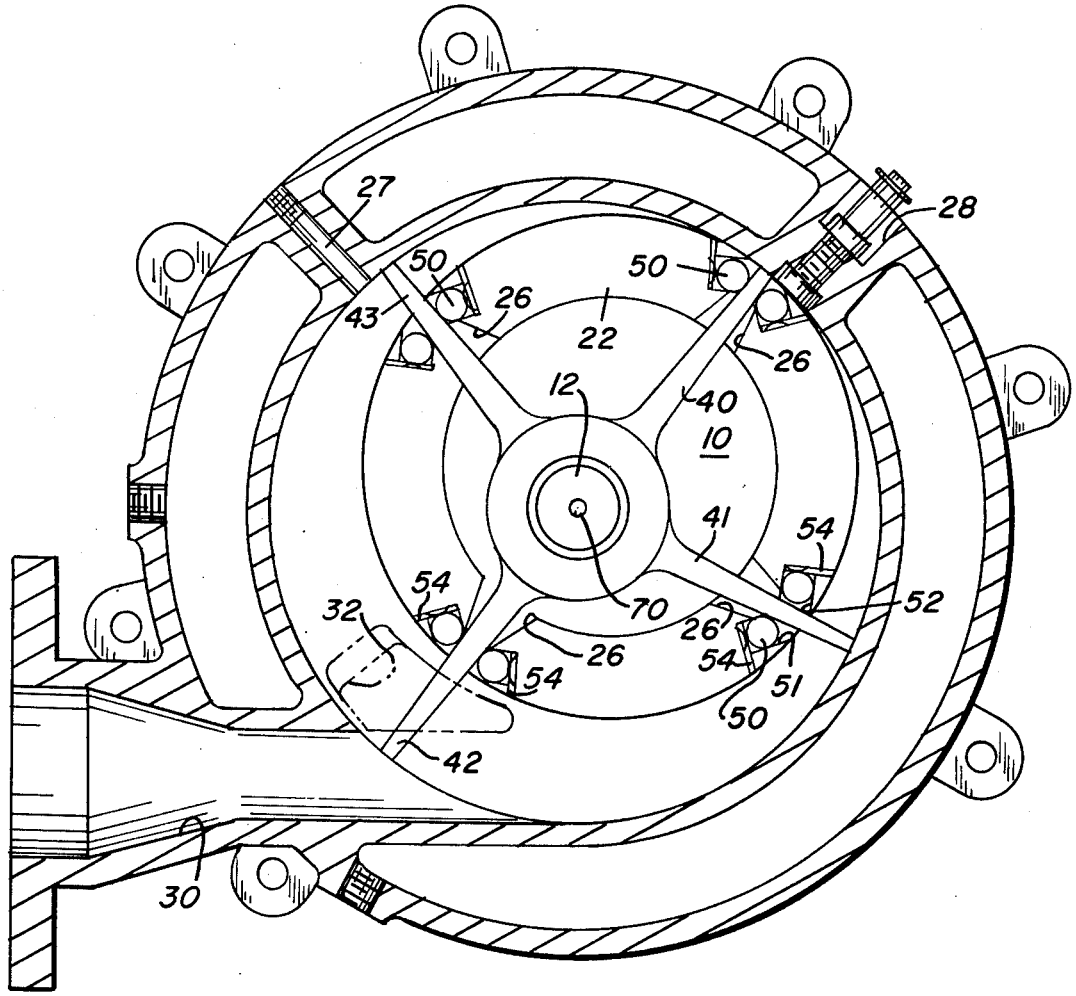
FIG. 2 is generally a section view of the two cycle rotary engine shown in FIG. 1 with the vanes position changed.

Referring now to FIGS. 1 and 2 there is shown a more detailed view of a rotary engine 10 constructed according to the teaching of the present invention. Stationary shaft 12 is formed integral with or rigidly connected to housing 14. Rotor ring 22 has connected at one end a power take off shaft 23. Rotor ring 22 has formed at the other end a circular bearing support member 25. Members 22, 23, and 25 move as a unit. Bearings 60, 62, and 64 support members 22, 23, and 25 for rotating movement. The rotor is thus formed of four identical rotor segments held between the two flange members 23 and 25 which are supported by bearings 60 and 62. An opening 70 is formed through center shaft 12. Oil is pumped through passage 70 which connects to a passage 72 into the center chamber formed inside of rotor ring 22. Oil on the inside of cylindrical rotor 22 is forced by centrifugal force to the cavities behind the roller seals. Excess oil is ported at both ends of rotor 22. Oil from passage 70 is also fed to roller bearing 60. An oil feed is provided for roller bearing 62.

Passages 74 are provided in housing 14 through which cooling water is forced. The cooling water forced through the passages 74 in housing 14 effectively cools rotary engine 10. The housing 14 can be formed by three members which are clamped together as shown in FIG. 1.

The disclosed rotary engine 10 utilizes a roller seal which is relatively simple and superior to prior art seals. The seal also permits the use of tapered vanes which has the advantage of increasing the strength at the hub and reducing the centrifugal force which has been a potential problem with prior art engines. The disclosed engine provides a high horsepower in a relatively small size unit.

What is claimed is:

1. In a vane type rotary engine having a plurality of rotatable tapered vanes supported at one end within a hollow rotor and extending through openings in the rotor wall to make sliding contact with the inside of a housing, each vane having a taper from its supported end to its free end, a vane seal is provided for each vane to provide a seal between the inside and the outside of said rotor, said vane seal comprising:
   - a pair of slots formed in the rotor wall on opposite sides of each opening through which a vane extends;
   - a roller, disposed in each slot, sized for a close tolerance fit in the associated slot; and,
   - a passage extending from each slot behind the contained roller, to the outside surface of said rotor.

2. A seal as claimed in claim 1 wherein:
   said passage is of a relatively small size.

3. A seal as claimed in claim 2 comprising:
   a biasing spring disposed behind each roller to urge each roller into contact with the vanes.

4. In a vane type rotory engine having a plurality of rotatable vanes supported at one end within a hollow rotor and extending through openings in the rotor wall to make sliding contact with the inside of a housing, a vane seal comprising:
   - a pair of slots formed in the rotor wall on opposite sides of each opening through which a vane extends;
   - a roller disposed in each slot;
   - a passage extending from each slot, behind the contained roller, to the outside surface of said rotor; and,
   - check valve means formed in said passage.

5. A seal as claimed in claim 4 wherein:
   the vane seals are constructed to accommodate a tapered vane.

6. A seal as claimed in claim 5 wherein:
   said pair of slots are oriented so that as the rotor rotates, said rollers are urged by centrifugal force into contact with the vanes.

7. A rotory engine comprising:
   - a housing;
   - a stationary shaft supported within said housing;
   - a plurality of vanes rotatably connected to said stationary shaft and extending in close proximity to the inside of said housing;
   - said vanes having a taper from their connection end to their free end;
   - a hollow cylindrical rotatable member disposed around said stationary shaft and positioned off center therefrom with a plurality of openings formed therein through which said plurality of vanes extend;
   - a pair of slotted openings formed in the wall of said hollow cylindrical rotatable member on opposite sides of each opening;
   - a roller disposed in each slotted opening and fitting within the associated opening with a close tolerance;
   - biasing means for biasing each roll into contact with the associated vane to seal the outside of said hollow cylindrical rotatable member from the inside; and,
   - a passage formed in each slotted opening, behind the associated roller, extending to the outside of said hollow cylindrical rotatable member.

8. A rotary engine as claimed in claim 7 wherein:
   said biasing means comprises a spring disposed behind each roller.

9. A rotary engine as claimed in claim 7 comprising:
   check valve means disposed in each of said passages.

10. A rotary engine as claimed in claim 7 wherein:
   said passage is of a relatively small cross section.

11. A rotary engine as claimed in claim 7 wherein:
   each slotted opening is disposed so that when said hollow cylindrical rotatable member is rotated, said roller is urged by centrifugal force into contact with the associated vane.

12. A rotary engine as claimed in claim 7 comprising:
   an oil passage formed through said stationary shaft communicating with the inside of said hollow cylindrical rotatable member.

13. A rotary engine as claimed in claim 12 comprising:
   water cooling passages formed through said housing.

14. A rotary engine comprising:
   - a housing;
   - a stationary shaft supported within said housing;
   - a plurality of vanes rotatably connected to said stationary shaft and extending in close proximity to the inside of said housing;
   - a hollow cylindrical rotatable member disposed around said stationary shaft and positioned off center therefrom with a plurality of openings formed therein through which said plurality of vanes extend;
   - a pair of slotted openings formed in the wall of said hollow cylindrical rotatable member on opposite sides of each opening;
   - a roller disposed in each slotted opening;
   - biasing means for biasing each roll into contact with the associated vane to seal the outside of said hollow cylindrical rotatable member from the inside;
   - a passage formed in each slotted opening, behind the associated roller, extending to the outside of said hollow cylindrical rotatable member; and,
   - a check valve connected in said passage to restrict fluid flow from said slotted opening to the outside of said hollow cylindrical member.

* * * * *